US006570330B2

(12) United States Patent
Nagamachi et al.

(10) Patent No.: US 6,570,330 B2
(45) Date of Patent: May 27, 2003

(54) RESISTOR FOR ELECTRON GUN ASSEMBLY, METHOD OF MANUFACTURING THE RESISTOR, ELECTRON GUN ASSEMBLY HAVING THE RESISTOR, AND CATHODE-RAY TUBE APPARATUS HAVING THE RESISTOR

(75) Inventors: Nobuhiro Nagamachi, Himeji (JP); Yoshihisa Kaminaga, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 6 days.

(21) Appl. No.: 10/022,877

(22) Filed: Dec. 20, 2001

(65) Prior Publication Data

US 2002/0101203 A1 Aug. 1, 2002

(30) Foreign Application Priority Data

Dec. 26, 2000 (JP) ..... 2000-395296
Nov. 13, 2001 (JP) ..... 2001-347692

(51) Int. Cl.[7] ..... H01J 23/16
(52) U.S. Cl. ..... 315/3; 313/417; 313/450
(58) Field of Search ..... 315/3, 15, 16, 315/381, 382.1, 368.15; 313/402, 409, 414, 412, 417, 450, 456, 467

(56) References Cited

U.S. PATENT DOCUMENTS 6,294,872 B1 * 9/2001 Tsuruoka et al. ..... 315/3
6,433,469 B1 * 8/2002 Tsuruoka et al. ..... 315/368.15
6,445,117 B1 * 9/2002 Miyamoto et al. ..... 315/3

FOREIGN PATENT DOCUMENTS

JP 6-310052 11/1994 ..... H01J/29/48

* cited by examiner

*Primary Examiner*—Hoang Nguyen
(74) *Attorney, Agent, or Firm*—Oblon, Spivak, McClelland, Maier & Neustadt, P.C.

(57) ABSTRACT

A resistor for an electron gun assembly, for applying a resistor-divided voltage to an electrode provided in the electron gun assembly, comprises an insulative substrate, at least two first resistor elements disposed at predetermined positions on the insulative substrate, and a second resistor element having a predetermined pattern which electrically connects the first resistor elements. The resistor has a structure in which an effective length of the second resistor element between the first resistor elements varies in accordance with a position of the second resistor element relative to the first resistor elements.

16 Claims, 5 Drawing Sheets

| | FIG.3 | FIG.4 | FIG.5 | FIG.6 | FIG.7 | FIG.8 | FIG.9 | FIG.10 | FIG.11 |
|---|---|---|---|---|---|---|---|---|---|
| Resistance change value | Reference value | +25MΩ | -43MΩ | Reference value | +10MΩ | -8MΩ | Reference value | +23MΩ | -19MΩ |
| RD1 | Reference value | +0.6% | -1.2% | Reference value | +1.1% | -1.2% | Reference value | +1.0% | -1.0% |
| RD2 | Reference value | +0.4% | -1.0% | Reference value | +0.8% | -1.1% | Reference value | +0.9% | -1.0% |

RESISTOR FOR ELECTRON GUN ASSEMBLY, METHOD OF MANUFACTURING THE RESISTOR, ELECTRON GUN ASSEMBLY HAVING THE RESISTOR, AND CATHODE-RAY TUBE APPARATUS HAVING THE RESISTOR

CROSS-REFERENCE TO RELATED APPLICATIONS

This application is based upon and claims the benefit of priority from the prior Japanese Patent Applications No. 2000-395296, filed Dec. 26, 2000; and No. 2001-347692, filed Nov. 13, 2001, the entire contents of both of which are incorporated herein by reference.

BACKGROUND OF THE INVENTION

1. Field of the Invention

The present invention relates generally to a resistor for an electron gun assembly provided in a cathode-ray tube (CRT) apparatus, etc., and a method of manufacturing the resistor, and more particularly to a resistor for applying a resistor-divided voltage to an electrode provided in the electron gun assembly, and a method of manufacturing the resistor.

2. Description of the Related Art

Recently, a high voltage is required in a color cathode-ray tube apparatus in order to enhance the image quality. Accordingly, there is a possibility that a circuit element may be damaged by a spark current or discharge noise due to an intra-tube discharge. In this high-voltage use environment, a CRT apparatus includes a resistor for resistor-dividing a high voltage supplied to electrodes of an electron gun assembly to prevent the discharge and enhance the image quality.

Principal requirements for the resistor for the electron gun assembly are: 1) the resistor is stable in a breakdown voltage treatment or a heating step in a color CRT manufacturing process, 2) a variance in resistance and the amount of emission gas due to joule heat produced in operation are small, 3) the resistor does not become a secondary electron emission source when it is hit by dispersion electrons, and 4) the resistor does not disturb an electric field of the electron gun assembly, does not discharge, or does not displace the trajectory of electrons.

When specifications of the electron gun assembly are changed, the voltages to be supplied to respective electrodes of the electron gun assembly are varied in some cases. In this case, it is necessary to change a resistance division ratio in accordance with application voltages to the electrodes so as to supply optimal voltages to the electrodes in conformity to the changed specifications.

However, in the case of a resistor formed with a predetermined resistance division ratio, the resistance value of the resistor is adjustable only by a conventional trimming method. With the trimming method, the resistance value is only adjustable such that it is increased. In addition, in a resistor manufacturing process using screen printing, many resistors are formed at a time. To adjust the resistance value of each resistor by the trimming method will considerably decrease the manufacturing yield and is unfeasible.

Under the circumstances, when a resistance division ratio needs to be changed, a new resistor needs to be designed. A long time is required for completion of the design, evaluation, etc. of the new resistor. Consequently, the beginning of practical use of the new resistor will be delayed, and the beginning of practical use of the electron gun assembly and the CRT apparatus using the assembly will also be delayed.

The present invention has been made in consideration of the above problems, and an object of the invention is to provide a resistor for an electron gun assembly, which is easily provided with a predetermined resistance division ratio without lowering a manufacturing yield, a method of manufacturing the resistor, an electron gun assembly having the resistor, and a CRT apparatus having the resistor.

Another object of the invention is to provide a resistor for an electron gun assembly, which can prevent a decrease in manufacturing yield and the occurrence of a non-usable screen due to a shift of a division ratio caused by a variance among screens used in manufacture, a method of manufacturing the resistor, an electron gun assembly having the resistor, and a CRT apparatus having the resistor.

BRIEF SUMMARY OF THE INVENTION

According to a first aspect of the invention, there is provided a resistor for an electron gun assembly, for applying a resistor-divided voltage to an electrode provided in the electron gun assembly, the resistor comprising: an insulative substrate; a plurality of first resistor elements disposed at predetermined positions on the insulative substrate; and a second resistor element having a predetermined pattern which electrically connects the first resistor elements, wherein the resistor has a structure in which an effective length of the second resistor element between the first resistor elements varies in accordance with a position of the second resistor element relative to the first resistor elements.

According to a second aspect of the invention, there is provided a method of manufacturing a resistor for an electron gun assembly, for applying a resistor-divided voltage to an electrode provided in the electron gun assembly, the method comprising: a step of forming a plurality of first resistor elements disposed at predetermined positions on an insulative substrate; and a step of forming a second resistor element having a predetermined pattern which electrically connects the first resistor elements, wherein an effective length of the second resistor element between the first resistor elements varies in accordance with a position of the second resistor element relative to the first resistor elements.

According to a third aspect of the invention, there is provided an electron gun assembly comprising a plurality of electrodes constituting an electron lens section for focusing or diverging electron beams, and a resistor for applying a resistor-divided voltage to at least one of the electrodes, wherein the resistor comprises: an insulative substrate; a plurality of first resistor elements disposed at predetermined positions on the insulative substrate; and a second resistor element having a predetermined pattern which electrically connects the first resistor elements, and wherein the resistor has a structure in which an effective length of the second resistor element between the first resistor elements varies in accordance with a position of the second resistor element relative to the first resistor elements.

According to a fourth aspect of the invention, there is provided a cathode-ray tube apparatus comprising: an electron gun assembly comprising a plurality of electrodes constituting an electron lens section for focusing or diverging electron beams, and a resistor for applying a resistor-divided voltage to at least one of the electrodes; and a deflection yoke for producing deflection magnetic fields for deflecting the electron beams emitted from the electron gun assembly, wherein the resistor comprises: an insulative substrate; a plurality of first resistor elements disposed at predetermined positions on the insulative substrate; and a second resistor element having a predetermined pattern which electrically connects the first resistor elements, and wherein the resistor has a structure in which an effective length of the second resistor element between the first resistor elements varies in accordance with a position of the second resistor element relative to the first resistor elements.

According to the above structures, the position of arrangement of the second resistor element is changed relative to the first resistor elements, whereby the effective wiring length of the second resistor element disposed between the first resistor elements is varied. Accordingly, the resistance value corresponding to the effective wiring length of the second resistor element can easily be varied. By adjusting the resistance value between the first resistor elements, the resistance division ratio can easily be altered and a predetermined necessary resistance division ratio can be obtained.

Thus, when a supply voltage needs to be varied in accordance with a change of specifications of the electron gun assembly, or when a resistance value needs to be adjusted in the process of manufacturing the resistor using screen printing, a predetermined resistance division ratio can easily be obtained without causing a decrease in manufacturing yield.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will now be described with reference to the accompanying drawings.

Figure 1:
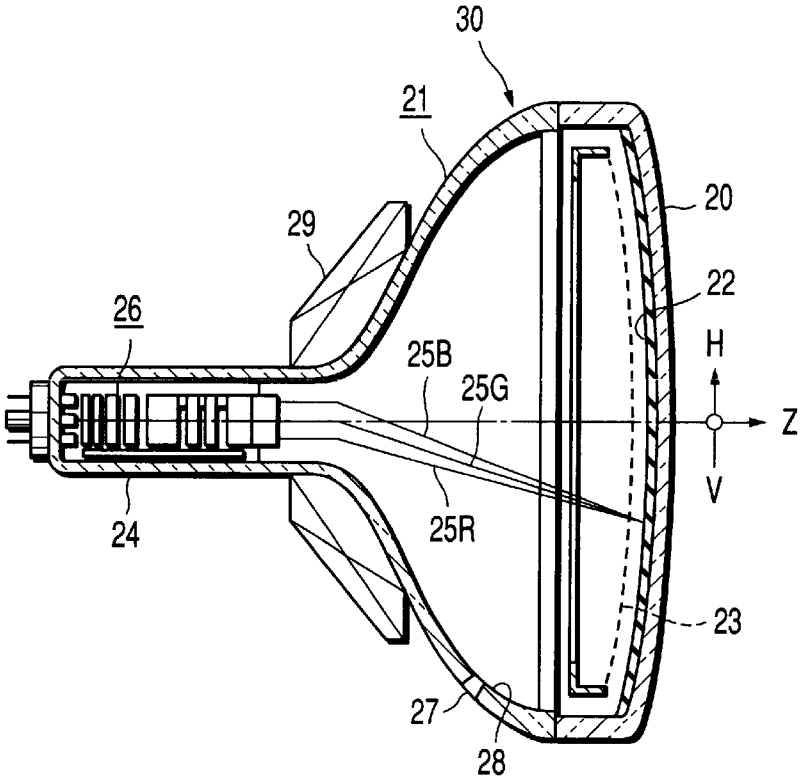
FIG. 1 is a horizontal cross-sectional view schematically showing the structure of a color CRT apparatus as an example of a CRT apparatus to which a resistor for an electron gun assembly according to an embodiment of the present invention is applied.

As is shown in FIG. 1, a color cathode-ray tube (CRT) apparatus, which is an example of a CRT apparatus, has a vacuum envelope 30. The vacuum envelope 30 has a panel 20 and a funnel 21 integrally coupled to the panel 20. The panel 20 has, on its inner surface, a phosphor screen 22 having three-color phosphor layers which emit blue, green and red light, respectively. A shadow mask 23 is disposed to face the phosphor screen 22. The shadow mask 23 has many electron beam passage holes in its inner part.

An electron gun assembly 26 is disposed within a neck 24 of the funnel 21. The electron gun assembly 26 emits three electron beams 25B, 25G and 25R toward the phosphor screen 22 in a tube axis direction, i.e. a Z-axis direction. The three electron beams emitted from the electron gun assembly 26 comprise a center beam 25G and a pair of side beams 25B and 25R arranged in line in the same plane in a horizontal direction, i.e. an H-axis direction.

The funnel 21 is provided with an anode terminal 27. A graphite inner conductor film 28 is formed on the inner surface of the funnel 21. A deflection yoke 29 is provided on the outside of the funnel 21. The deflection yoke 29 produces non-uniform deflection magnetic fields for deflecting the three electron beams 25B, 25G and 25R emitted from the electron gun assembly 26. The deflection yoke 29 comprises a horizontal deflection coil for producing a pincushion-shaped horizontal deflection magnetic field and a vertical deflection coil for producing a barrel-shaped vertical deflection magnetic field.

In the color CRT apparatus with the above structure, the three electron beams 25B, 25G and 25R emitted from the electron gun assembly 26 are deflected by the non-uniform magnetic fields produced by the deflection yoke 29, while being self-converged on the phosphor screen 22. Thus, the three electron beams 25B, 25G and 25R scan the phosphor screen 22 in the horizontal direction H and vertical direction V. Thereby, a color image is displayed on the phosphor screen 22.

Figure 2:
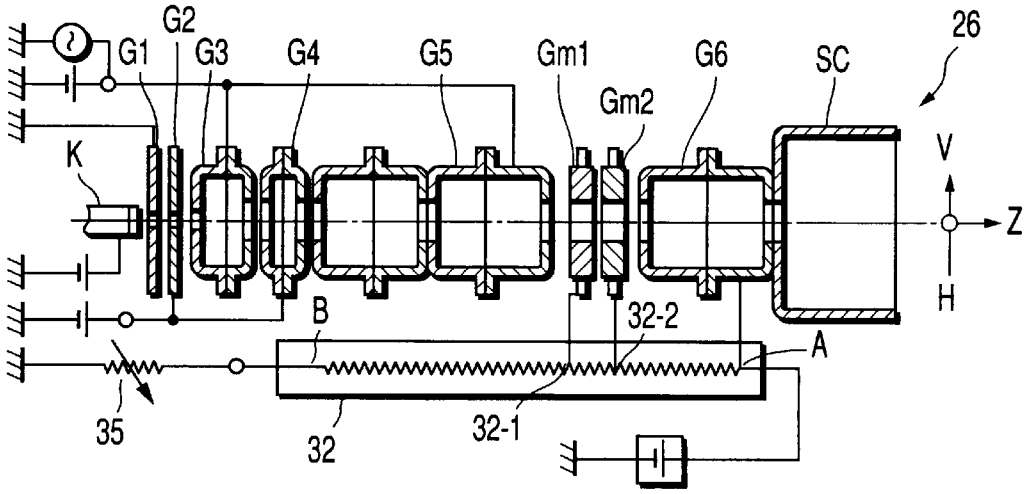
FIG. 2 is a vertical cross-sectional view schematically showing the structure of an example of an electron gun assembly having a resistor for an electron gun assembly according to an embodiment of the invention.

As is shown in FIG. 2, the electron gun assembly 26 comprises three cathodes K (B, G, R) arranged in line in the horizontal direction H, and a plurality of electrodes arranged on the same axis in the tube axis direction Z. These electrodes, i.e. a first electrode G1, a second electrode G2, a third electrode G3, a fourth electrode G4, a fifth electrode (focus electrode) G5, a first intermediate electrode Gm1, a second intermediate electrode Gm2, a sixth electrode (ultimate acceleration electrode) G6, and a sealed cup SC, are successively arranged from the cathodes K (R, G, B) toward the phosphor screen 22.

The three cathodes K (B, G, R), first to sixth electrodes G1 to G6 and first and second intermediate electrodes Gm1 and Gm2 are clamped in the vertical direction V by a pair of insulating supports (not shown), i.e. bead glasses, and thus integrally fixed. The sealed cup SC is attached and electrically connected to the sixth grid G6.

The first electrode G1 and second electrode G2 are formed of relatively thin plate-shaped electrodes. Each of the third electrode G3, fourth electrode G4, fifth electrode G5 and sixth electrode G6 is formed of a cylindrical electrode having an integral structure formed by coupling a plurality of cup-shaped electrodes. The first intermediate electrode Gm1 and second intermediate electrode Gm2 interposed between the fifth electrode G5 and sixth electrode G6 are formed of relatively thick plate-shaped electrodes. Each of these electrodes has three electron beam passage holes for passing three electron beams in association with the three cathodes K (R, G, B).

A resistor 32 is disposed near the electron gun assembly 26. One end portion A of the resistor 32 is connected to the sixth grid G6. The other end portion B of the resistor 32 is grounded directly or via a variable resistor 35 outside the tube, via a stem pin air-tightly penetrating a stem portion that seals the end portion of the neck. The resistor 32 is connected to the first intermediate electrode Gm1 at a first connection terminal 32-1 provided on the end portion (B) side of the intermediate portion of the resistor 32. In addition, the resistor 32 is connected to the second intermediate electrode Gm2 at a second connection terminal 32-2 provided on the end portion (A) side of the intermediate portion of the resistor 32.

Predetermined voltages are supplied to the respective electrodes of the electron gun assembly 26 via stem pins air-tightly penetrating the stem portion. Specifically, a voltage obtained by superimposing image signals on a DC voltage of, e.g. about 190V is applied to the cathodes K (B, G, R). The first electrode G1 is grounded. The second electrode G2 and fourth electrode G4 are connected within the tube and supplied with a DC voltage of about 800V. The third electrode G3 and fifth electrode G5 are connected within the tube and supplied with a dynamic focus voltage obtained by superimposing on a DC voltage of about 8 to 9 kV an AC component voltage varying parabolically in synchronism with deflection of electron beams.

An anode high voltage of about 30 kV is applied from the anode terminal 27 to the sixth electrode G6. More specifically, this voltage is applied to the sixth electrode G6 from the anode terminal 27 provided on the funnel 21 through the inner conductor film 28, a plurality of bulb spacers (not shown) attached to the sealed cup SC and put in pressure contact with the inner conductor film 28, and the sealed cup SC.

The first intermediate electrode Gm1 is supplied with a voltage obtained by resistor-dividing a high voltage applied to the sixth electrode G6 through the resistor 32, e.g. a voltage of about 40% of the anode high voltage. The second intermediate electrode Gm2 is supplied with a voltage obtained by similar resistor division, e.g. a voltage of about 65% of the anode high voltage.

With the application of the above voltages to the electrodes of the electron gun assembly, the cathodes K (B, G, R), first electrode G1 and second electrode G2 constitute an electron beam generating section for generating electron beams. The second electrode G2 and third electrode G3 constitute a prefocus lens for prefocusing the electron beams generated by the electron beam generating section.

The third electrode G3, fourth electrode G4 and fifth electrode G5 constitute a sub-lens for further focusing the electron beams prefocused by the prefocus lens. The fifth electrode G5, first intermediate electrode Gm1, second intermediate electrode Gm2 and sixth electrode G6 constitute a main lens for ultimately focusing the electron beams, which have been focused by the sub-lens, on the phosphor screen.

The structure of the resistor 32 will now be described in greater detail.

First Embodiment

Figure 3:
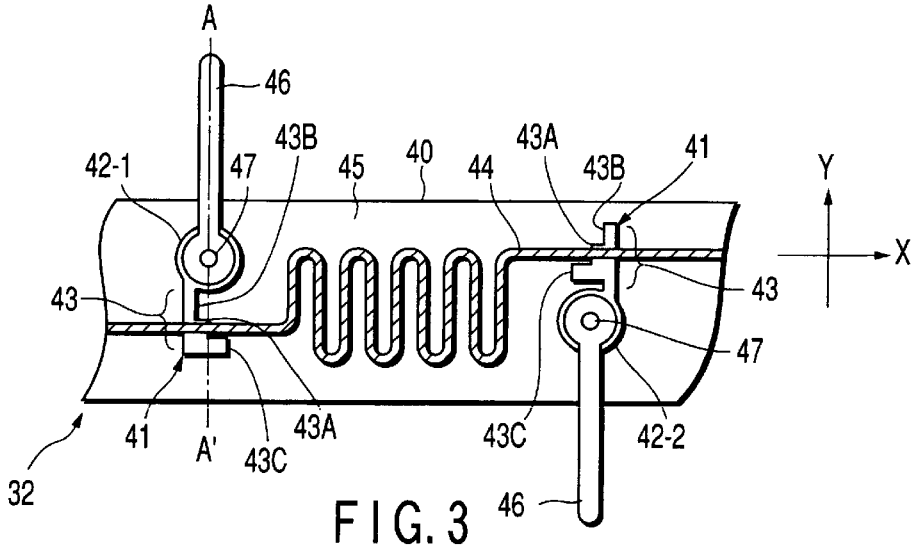
FIG. 3 is a plan view schematically showing the structure of a part of a resistor for an electron gun assembly according to a first embodiment of the invention.
Figures 12, 13:
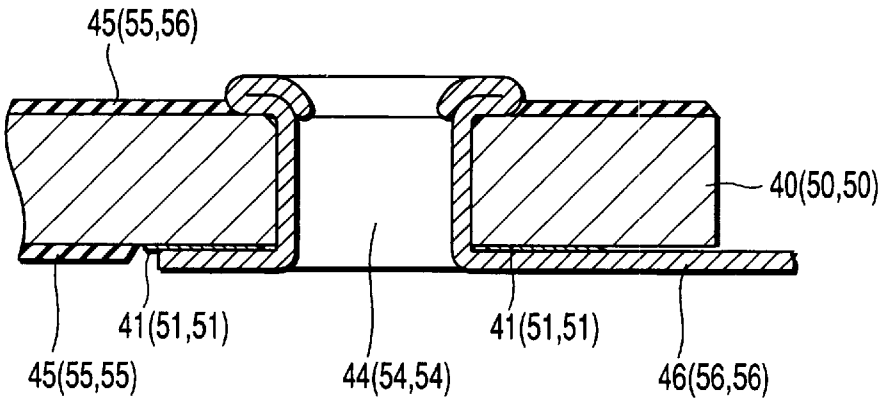
FIG. 12 is a cross-sectional view schematically showing the structure of a part of a resistor for an electron gun assembly according to an embodiment of the invention.
FIG. 13 is a table showing measurement results relating to changes in resistance value and resistance division ratio in the respective resistors shown in FIGS. 3 to 11.

As is shown in FIGS. 3 and 12, the resistor 32 comprises an insulative substrate 40, a plurality of first resistor elements 41 disposed at predetermined positions on the insulative substrate 40, and a second resistor element 44 having a predetermined pattern which electrically connects the first resistor elements 41. The resistor 32 further comprises a glass insulation coating film 45 and metal tabs 46.

The insulative substrate 40 is formed of a plate-shaped ceramic material such as aluminum oxide. The first resistor element 41 is formed of a relatively low-resistance material (a low-resistance paste material with a sheet resistance of e.g. 1 kΩ/□) containing a metal oxide such as ruthenium oxide or a glass such as lead borosilicate-based glass. The first resistor element 41 is formed by print-coating on the insulative substrate 40 using a screen printing method.

The first resistor elements 41 include terminal portions 42 (−1, −2, . . . ) and resistance adjusting portions 43. The terminal portions 42 are provided at through-holes 47 formed in advance in the insulative substrate 40 at predetermined intervals. The resistance adjusting portions 43 are disposed in association with the respective terminal portion 42 (−1,−2, . . . ), and these are electrically connected. In short, in the first resistor element 41, the terminal portion 42 and resistance adjusting portion 43 are integrally formed. The terminal portions 42 and resistance adjusting portions 43 may be formed in the same step or different steps.

The resistance adjusting portion 43 is configured such that the effective wiring length of the second resistor element 44 provided between the first resistor elements 41 varies in accordance with the position of the second resistor element 44 relative to the first resistor elements 41. Specifically, when the first resistor elements 41 and second resistor element 44 are connected, the second resistor element 44 is connected to one of positions of the resistance adjusting portion 43 of first resistor elements 41 so that the effective wiring length of the second resistor element 44 between the two first resistor elements 41 can be varied. In the first embodiment, the resistance adjusting portion 43 is included in the first resistor element 41 and formed to have a stepwise projection shape in the direction X of extension of the second resistor element 44.

The second resistor element 44 is formed of a relatively high-resistance material (a high-resistance paste material with a sheet resistance of e.g. 5 kΩ/□) containing a metal oxide such as ruthenium oxide or a glass such as lead borosilicate-based glass. The second resistor element 44 is formed by print-coating on the insulative substrate 40 using a screen printing method. The second resistor element 44 has a predetermined pattern, e.g. a corrugated pattern, and is arranged to contact the resistance adjusting portions 43 of first resistor elements 41. In short, the second resistor element 44 is electrically connected to the terminal portions 42 via the resistance adjusting portions 43 of first resistor elements 41.

The glass insulation coating film 45 is formed of a relatively high-resistance material consisting essentially of, e.g. a transition metal oxide and lead borosilicate-based glass. The glass insulation coating film 45 is formed by print-coating using a screen printing method so as to cover the insulative substrate 40, first resistor elements 41 and second resistor element 44 and also the entire back surface. Thereby, the breakdown voltage of the resistor 32 is enhanced and the emission of gas is prevented.

The metal tabs 46 are connected to the associated terminal portions 42 and attached to the through-holes 47 by caulking. The metal tabs 46 function as connection terminals for supplying voltage to the intermediate electrodes Gm1 and Gm2 and the end portions A and B in the above-described electron gun assembly 26.

In the above-described resistor 32, the resistance adjusting portion 43 connected to the first terminal portion 42-1 has a first position 43A serving as a central reference position, a second position 43B located on the terminal portion 42 side of the first position 43A, and a third position 43C located on that side of the first position 43A, which is opposite to the terminal portion 42. On the other hand, the resistance adjusting portion 43 connected to the second terminal portion 42-2 has a first position 43A serving as a central reference position, a second position 43B located on that side of the first position 43A, which is opposite to the terminal portion 42, and a third position 43C located on the terminal portion 42 side of the first position 43A.

The first position 43A of the resistance adjusting portion 43 connected to the first terminal portion 42-1 is projected from the second position 43B toward the second terminal portion 42-2 in the direction X. The first position 43A of the resistance adjusting portion 43 connected to the second terminal portion 42-2 is projected from the second position 43B toward the first terminal portion 42-1 in the direction X. Accordingly, the X-directional length of the portion at the second position 43B of the resistance adjusting portion 43 is less than that of the portion at the first position 43A by, e.g. 0.5 mm.

Thus, the portions at the second positions 43B, compared to the portions at the first positions 43A, are configured to substantially increase the distance between the terminal portions 42. Specifically, the second resistor element 44 when arranged between the second positions 43B has a greater effective wiring length than the second resistor element 44 when arranged between the first positions 43A. Accordingly, the resistance value of the second resistor element 44 arranged between the second positions 43B is higher than that of the second resistor element 44 arranged between the first position 43A.

The third position 43C of the resistance adjusting portion 43 connected to the first terminal portion 42-1 is projected from the first position 43A toward the second terminal portion 42-2 in the direction X. The third position 43C of the resistance adjusting portion 43 connected to the second terminal portion 42-2 is projected from the first position 43A toward the first terminal portion 42-1 in the direction X. Accordingly, the X-directional length of the portion at the third position 43C of the resistance adjusting portion 43 is greater than that of the portion at the first position 43A by, e.g. 1.0 mm.

Thus, the portions at the third positions 43C, compared to the portions at the first positions 43A, are configured to substantially decrease the distance between the terminal portions 42. Specifically, the second resistor element 44 when arranged between the third positions 43C has a less effective wiring length than the second resistor element 44 when arranged between the first positions 43A. Accordingly, the resistance value of the second resistor element 44 arranged between the third positions 43C is lower than that of the second resistor element 44 arranged between the first position 43A.

The method of manufacturing the resistor 32 will now be described.

To start with, an insulative substrate having through-holes 47 arranged at predetermined intervals is prepared. A low-resistance paste material is print-coated on the insulative substrate 40 by a screen printing method. At this time, the low-resistance paste material is coated through a screen which forms terminal portions 42 and resistance adjusting portions 43 electrically connected to the terminal portions 42 in association with the through-holes 47. Then, the coated low-resistance paste material is dried at 150° C.

Subsequently, a high-resistance paste material is print-coated on the insulative substrate 40 by the screen printing method, dried at 150° C., and baked at 800 to 900° C. Thereby, the first resistor elements 41 having terminal portions 42 and resistance adjusting portions 43 and the second resistor element 44 electrically connected to the first resistor elements 41 are formed. At this time, the second resistor element 44 is formed such that the whole resistor 32 has a predetermined resistance, e.g. $0.1\times10^{9}$ to $2.0\times10^{9}\Omega$.

In the step of printing the high-resistance paste material, when a predetermined resistance is obtained between the first resistor elements 41, the screen is aligned at the reference position, as shown in FIG. 3, such that the pattern corresponding to the second resistor element 44 on the screen may contact the first positions 43A of the resistance adjusting portions 43 of first resistor elements 41. The high-resistance paste material is print-coated through the screen.

Then, the glass insulation coating film 45 is print-coated by the screen printing method to cover the insulative substrate 40, first resistor elements 41 and second resistor element 44. Subsequently, the coated film is dried at 150° C. and baked at 550 to 700° C. Further, the metal tabs 46 are attached to the through-holes 47. Thus, the resistor 32 having a predetermined resistance value is obtained.

On the other hand, in the step of printing the high-resistance paste material, when a resistance value higher than a predetermined resistance is obtained between the first resistor elements 41, it is necessary to increase the resistance value between the first terminal portion 42-1 and second terminal portion 42-2. That is, it is necessary to increase the effective wiring length of the second resistor element 44 between the first terminal portion 42-1 and second terminal portion 42-2.

Figure 4:
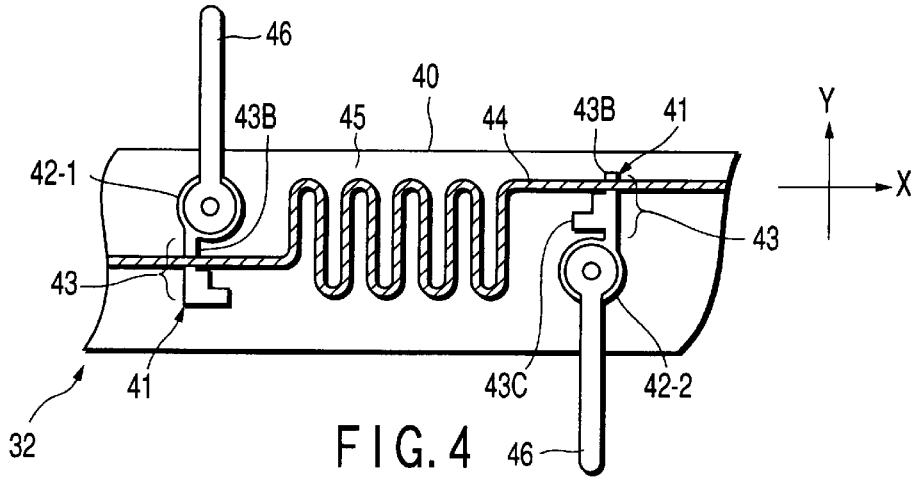
FIG. 4 is a plan view schematically showing the structure of the part of the resistor for an electron gun assembly according to the first embodiment.

In this case, as shown in FIG. 4, the pattern corresponding to the second resistor element 44 on the screen is shifted by a predetermined amount, e.g. +0.8 mm, from the reference position in the direction Y perpendicular to the direction X of extension of the second resistor element 44. Specifically, the screen is aligned such that the pattern corresponding to the second resistor element 44 may contact the second positions 43B of the resistance adjusting portions 43 of first resistor elements 41. The high-resistance paste material is print-coated through the screen.

Accordingly, the effective wiring length of the second resistor element 44 between the first terminal portion 42-1 and second terminal portion 42-2 is made greater than in the case shown in FIG. 3. Thus, the resistance value corresponding to the effective wiring length of the second resistor element 44 is made higher than in the case of FIG. 3. In this embodiment, the effective wiring length of the second resistor element 44 was made greater than in the case shown in FIG. 3 by 1.0 mm, and the resistance value corresponding to the effective wiring length of the second resistor element 44 was made higher than in the case of FIG. 3 by 25 MΩ.

In the step of printing the high-resistance paste material, when a resistance value lower than a predetermined resistance is obtained between the first resistor elements 41, it is necessary to decrease the resistance value between the first terminal portion 42-1 and second terminal portion 42-2. That is, it is necessary to decrease the effective wiring length of the second resistor element 44 between the first terminal portion 42-1 and second terminal portion 42-2.

Figure 5:
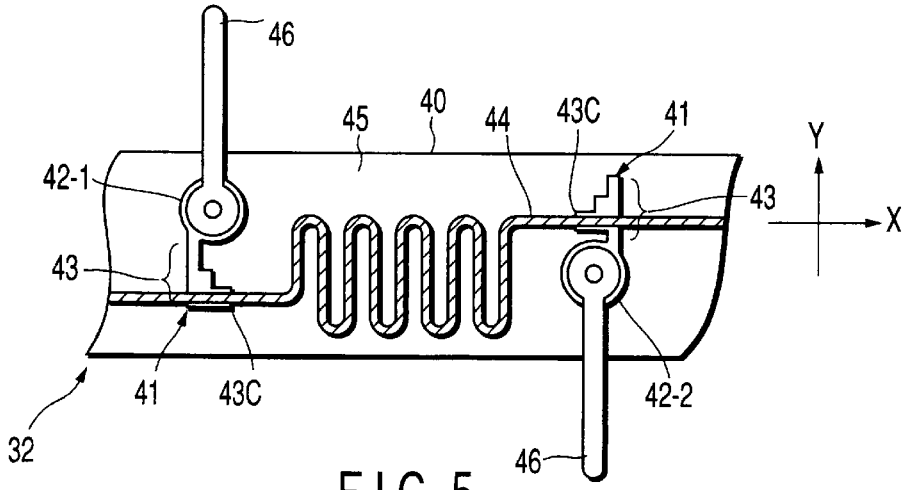
FIG. 5 is a plan view schematically showing the structure of the part of the resistor for an electron gun assembly according to the first embodiment.

In this case, as shown in FIG. 5, the pattern corresponding to the second resistor element 44 on the screen is shifted by a predetermined amount, e.g. −0.8 mm, from the reference position in the direction Y. Specifically, the screen is aligned such that the pattern corresponding to the second resistor element 44 may contact the third positions 43C of the resistance adjusting portions 43 of first resistor elements 41. The high-resistance paste material is print-coated through the screen.

Accordingly, the effective wiring length of the second resistor element 44 between the first terminal portion 42-1 and second terminal portion 42-2 is made less than in the case shown in FIG. 3. Thus, the resistance value corresponding to the effective wiring length of the second resistor element 44 is made lower than in the case of FIG. 3. In this embodiment, the effective wiring length of the second resistor element 44 was made less than in the case shown in FIG. 3 by 2.0 mm, and the resistance value corresponding to the effective wiring length of the second resistor element 44 was made lower than in the case of FIG. 3 by 43 MΩ.

As has been described above, the resistance division ratio of the voltage applied via the metal tabs 46 connected to the terminal portions 42 can be easily changed by adjusting the resistance value between the first resistor elements 41, and a predetermined necessary resistance division ratio can be obtained. In this context, the resistance division ratio is defined as follows. Refer to FIGS. 2 and 3. Assume that the terminal portion 42-1 corresponds to the connection terminal 32-1 of resistor 32, and the terminal portion 42-2 corresponds to the connection terminal 32-2 of the resistor 32. When a resistance between the terminal A and connection terminal 32-2 of the resistor 32 is R1, a resistance between the connection terminal 32-1 and connection terminal 32-2 is R2 and a resistance between the connection terminal 32-1 and the terminal B is R3, a resistance division ratio RD1 at the connection terminal 32-1 and a resistance division ratio RD2 at the connection terminal 32-2 are given by $$RD1=\{(R2+R3)/(R1+R2+R3)\}\times 100$$

$$RD2=\{R3/(R1+R2+R3)\}\times 100$$

As is shown in the table of FIG. 13, in the example of FIG. 4 in this embodiment, compared to the example of FIG. 3, the resistance division ratio RD1 of voltage applied via the metal tab 46 connected to the first terminal portion 42-1 increased by 0.6%, and the resistance division ratio RD2 of voltage applied via the metal tab 46 connected to the second terminal portion 42-2 increased by 0.4%. In the example of FIG. 5, compared to the example of FIG. 3, the resistance division ratio RD1 decreased by 1.2%, and the resistance division ratio RD2 decreased by 1.0%.

Accordingly, when supply voltage needs to be changed in accordance with the change of specifications of the electron gun assembly, a predetermined resistance division ratio can easily be obtained without causing a decrease in manufacturing yield.

This embodiment is also applicable to a case where the resistance value needs to be adjusted in the resistor manufacturing process using screen printing. There is a variance among screens used for printing. Thus, even when a screen is replaced with another with similar specifications, a resistance division ratio obtained by a finished resistor may differ. There is a case where a deviation of a resistance division ratio from a predetermined reference value is within a tolerable range but a mean value of the resistance division ratio may shift from the reference value.

For example, immediately after the screen is replaced with another, a trial printing is effected. A resistance division ratio of a resistor formed using the new screen is measured. If the resistance division ratio has shifted from the reference value, it is necessary to replace the screen with another. These steps need to be repeated until a screen, with which a desired resistance division ratio is obtained, is chosen.

The shift of the mean value of the resistance division ratio may be caused by the film thickness of the high resistance material of the second resistor element. When the second resistor element is to be formed with a film thickness of 15 μm, the mean value of the resistance division ratio will considerably shift if the film thickness varies by 1 μm. However, it is difficult to demand such a precision of screens, and many non-usable screens may occur. Moreover, resistors may not be manufactured according to production schedules.

If the above-described embodiment is applied, these problems can be solved. In the method of manufacturing the above-described resistor, the screen is aligned with the reference position, as shown in FIG. 3, such that the pattern corresponding to the second resistor element 44 on the screen may contact the first positions 43A of the resistance adjusting portions 43 of first resistor elements 41. The high-resistance paste material is print-coated through the screen.

Then, the glass insulation coating film 45 is print-coated by the screen printing method to cover the insulative substrate 40, first resistor elements 41 and second resistor element 44. Subsequently, the coated film is dried at 150° C. and baked at 550 to 700° C. Further, the metal tabs 46 are attached to the through-holes 47, thereby obtaining the resistor 32. The resistance division ratio of the terminal portions of the obtained resistor 32 is measured. If the measurement results of the resistance division ratio coincide with predetermined values or within a tolerable range of predetermined values, the screen used is aligned with the reference position of the resistance adjusting portions 43 and resistors are manufactured.

On the other hand, if the measurement results of the resistance division ratio are lower than predetermined values, it is necessary to increase the resistance value. That is, it is necessary to increase the effective wiring length of the second resistor element 44 between the first terminal portion 42-1 and second terminal portion 42-2. For this purpose, another insulative substrate 40 is prepared and first resistor elements 41 are formed, following which a second resistor element 44 is formed.

In this case, as shown in FIG. 4, the screen is shifted and aligned such that the pattern corresponding to the second resistor element 44 on the screen may contact the second positions 43B of the resistance adjusting portions 43 of first resistor elements 41. The high-resistance paste material is print-coated through the screen.

If the measurement results of the resistance division ratio are higher than predetermined values, it is necessary to decrease the resistance value. That is, it is necessary to decrease the effective wiring length of the second resistor element 44 between the first terminal portion 42-1 and second terminal portion 42-2. For this purpose, another insulative substrate 40 is prepared. First resistor elements 41 are formed, and then a second resistor element 44 is formed.

In this case, as shown in FIG. 5, the screen is shifted and aligned such that the pattern corresponding to the second resistor element 44 on the screen may contact the third positions 43C of the resistance adjusting portions 43 of first resistor elements 41. The high-resistance paste material is print-coated through the screen.

As has been described above, when the second resistor element is to be formed, the screen is aligned so as to pass through the first position (reference position) of the first resistor elements, and the high-resistance material is print-coated. The resistance division ratio of the second resistor of the thus formed second resistor element is measured, and an error from the predetermined values is calculated.

If the resistance division ratio is higher than a predetermined value, the screen is aligned so as to pass through the third positions of the first resistor elements so that the wiring length of the second resistor element may be shortened. The high-resistance material is print-coated using this screen, thereby forming the second resistor element. On the other hand, if the resistance division ratio is lower than a predetermined value, the screen is aligned so as to pass through the second positions of the first resistor elements so that the wiring length of the second resistor element may be increased. The high-resistance material is print-coated using this screen, thereby forming the second resistor element.

Subsequently, the alignment position of the screen for forming the second resistor element is fixed at one of the first position 43A, second position 43B and third position 43C in consideration of the variance of this screen, and resistors 32 are manufactured according to a regular manufacturing schedule.

According to the present embodiment, the variance of the screen, i.e. the error of the resistance division ratio from the predetermined value, is measured by a single (at most) trial printing step. Without replacing the screen, the alignment position of the screen is shifted on the basis of the measurement result. Thereby, an effective wiring length for obtaining an optimal resistance division ratio can be determined.

There is no need to choose a screen for obtaining a predetermined resistance division ratio, and occurrence of non-usable screens can be prevented. In the prior art, when a screen is replaced with another having similar specifications, two to five screens need to be chosen to obtain an optimal resistance division ratio and one to four non-usable screens occur. By contrast, according to the present embodiment, a substituted screen can be used in consideration of the variance of this screen, and a screen which is not usable will not occur.

In the prior art, the time for forming second resistor elements in 1000 resistors is about 5 hours. In the present invention, since it is not necessary to choose the screen, the time can be reduced to about one hour.

In the above-described embodiment, the resistance adjusting portion, which is configured to substantially change the effective wiring length of the second resistor element, is provided on the first resistor element, as shown in FIG. 3. However, this invention is not limited to this structure, and various modifications can be made.

Second Embodiment

Figure 6:
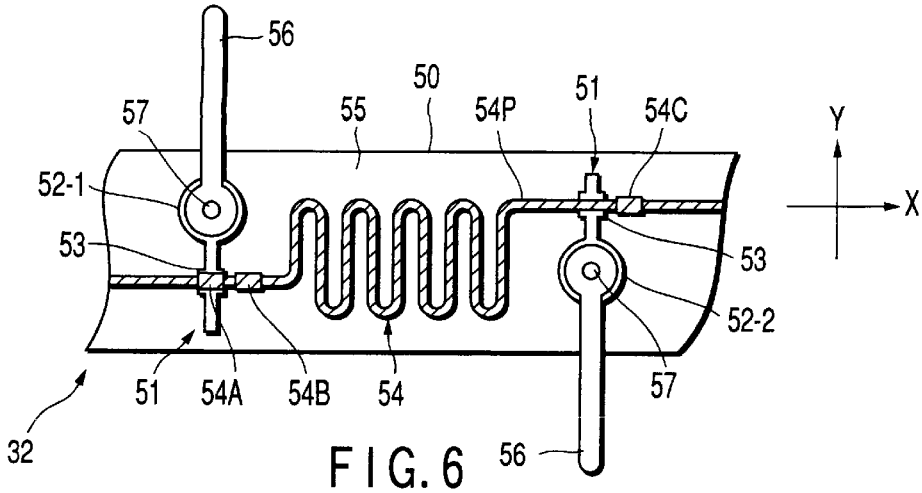
FIG. 6 is a plan view schematically showing the structure of a part of a resistor for an electron gun assembly according to a second embodiment of the invention.

As shown in FIGS. 6 and 12, the resistor 32 comprises an insulative substrate 50, a plurality of first resistor elements 51 disposed at predetermined positions on the insulative substrate 50, a second resistor element 54 having a predetermined pattern which electrically connects the first resistor elements 51, a glass insulation coating film 55 and metal tabs 56. This resistor 32 is formed of the same material and by the same method as in the first embodiment. However, the patterns of the first resistor elements 51 and second resistor element 54 are different from those in the first embodiment.

The first resistor elements 51 include terminal portions 52 (−1, −2, . . . ) and connection portions 53. The connection portions 53 are provided in association with the terminal portions 52, and these are electrically connected. In the first resistor element 51, the terminal portion 52 and connection portion 53 are integrally formed. The terminal portion 52 and connection portion 53 may be formed in the same step or different steps.

The second resistor element 54 comprises an effective wiring portion 54P and a plurality of resistance adjusting portions 54A, 54B and 54C provided at points on the effective wiring portion 54P. The second resistor element 44 has a predetermined pattern, e.g. a corrugated pattern, and is arranged to contact the connection portion 53 of each first resistor element 51. The effective wiring portion 54P and resistance adjusting portions 54A, 54B and 54C may be formed in the same step or different steps.

The resistance adjusting portions 54A, 54B and 54C are configured such that the effective wiring length of the second resistor element 54 provided between the first resistor elements 51, i.e. the length of the effective wiring portion 54P, varies in accordance with the position of the second resistor element 54 relative the first resistor elements 51. In the second embodiment, the resistance adjusting portions 54A, 54B and 54C are included in the second resistor element 54.

In the second resistor element 54, the line width of the effective wiring portion 54P is, e.g. 0.4 mm. The resistance adjusting portions 54A, 54B and 54C are formed to have a line width greater than the line width of the effective wiring portion 54P. For example, each of the resistance adjusting portions 54A, 54B and 54C has a line width of 0.8 mm (in the direction Y) and has a predetermined length, e.g. 1.0 mm, in the direction X of extension of the second resistor element 54.

The first resistance adjusting portion 54A and second resistance adjusting portion 54B are formed adjacent to each other at a predetermined distance. The first resistance adjusting portion 54A and second resistance adjusting portion 54B are disposed near the connection portion 53 integrally formed with the first terminal portion 52-1. The second resistance adjusting portion 54B is disposed on that side of the first resistance adjusting portion 54A, which is closer to the third resistance adjusting portion 54C. The third resistance adjusting portion 54C is disposed near the connection portion 53 integrally formed with the second terminal portion 52-2. In addition, in this embodiment, the distance in the direction X between the second resistance adjusting portion 54B and the third resistance adjusting portion 54C is nearly equal to the distance in the direction X between the connection portion 53 integrally connected to the first terminal portion 52-1 and the connection portion 53 integrally connected to the second terminal portion 52-2.

Each of the resistance adjusting portions 54A, 54B and 54C, which has a greater line width than the effective wiring portion 54P, has a lower resistance than the effective wiring portion 54P. Accordingly, the effective wiring length of the effective wiring portion 54P corresponds to the length of the effective wiring portion 54P between the resistance adjusting portions.

In the step of printing the high-resistance paste material for forming the second resistor element 54, when a predetermined resistance is obtained between the first resistor elements 51, the screen is aligned at the reference position, as shown in FIG. 6. That is, the screen is aligned such that the pattern corresponding to the first resistance adjusting portion 54A of second resistor element 54 may contact the connection portion 53 associated with the first terminal portion 52-1. The high-resistance paste material is print-coated through the screen.

In the second resistor element 54, the second resistance adjusting portion 54B is positioned between the first terminal portion 52-1 and second terminal portion 52-2, and the third resistance adjusting portion 54C is not positioned between the first terminal portion 52-1 and second terminal portion 52-2. In addition, the connection portion 53 associated with the second terminal portion 52-2 contacts the effective wiring portion 54P. In this case, the effective wiring length of the second resistor element 54 corresponds to the length between the second resistance adjusting portion 54B located near the connection portion 53 of first terminal portion 52-1 and that portion of the effective wiring portion 54P, which contacts the connection portion 53 of first terminal portion 52-2.

On the other hand, in the step of printing the high-resistance paste material, when a resistance value higher than a predetermined resistance is obtained between the first resistor elements 51, it is necessary to increase the resistance value between the first terminal portion 52-1 and second terminal portion 52-2. That is, it is necessary to increase the effective wiring length of the second resistor element 54 between the first terminal portion 52-1 and second terminal portion 52-2.

Figure 7:
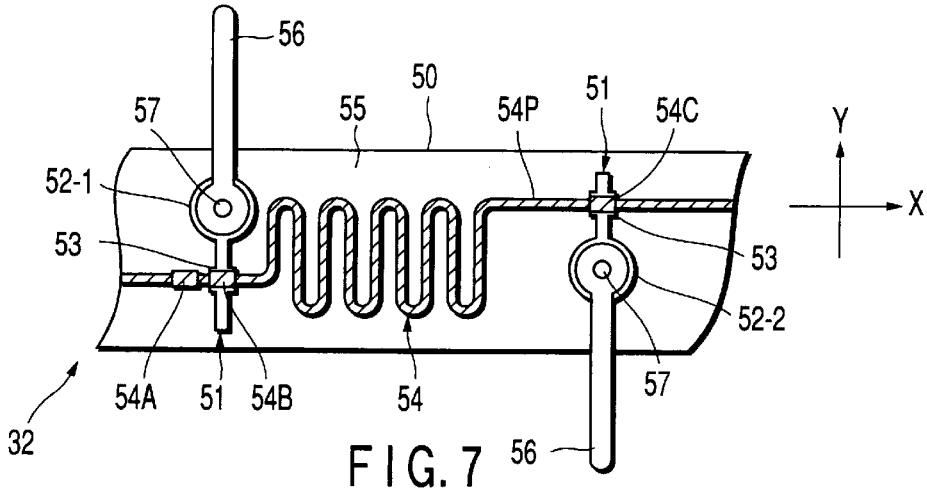
FIG. 7 is a plan view schematically showing the structure of the part of the resistor for an electron gun assembly according to the second embodiment.

In this case, as shown in FIG. 7, the pattern corresponding to the second resistor element 54 on the screen is shifted by a predetermined amount, e.g. −1.7 mm, from the reference position in the direction X of extension of the second resistor element 54. Specifically, the screen is aligned such that the pattern corresponding to the second resistance adjusting portion 54B of second resistor element 54 may contact the connection portion 53 associated with the first terminal portion 52-1. The high-resistance paste material is print-coated through the screen.

In the second resistor element 54, the first resistance adjusting portion 54A is not positioned between the first terminal portion 52-1 and second terminal portion 52-2, and the third resistance adjusting portion 54C is in contact with the connection portion associated with the second terminal portion 52-2. In this case, the effective wiring length of the second resistor element 54 corresponds to the length between the second resistance adjusting portion 54B put in contact with the connection portion 53 of first terminal portion 52-1 and the third resistance adjusting portion 54C put in contact with the connection portion 53 of first terminal portion 52-2.

Accordingly, the effective wiring length of the second resistor element 54 between the first terminal portion 52-1 and second terminal portion 52-2 is made greater than in the case shown in FIG. 6. Thus, the resistance value corresponding to the effective wiring length of the second resistor element 54 is made higher than in the case of FIG. 6. In this embodiment, the effective wiring length of the second resistor element 54 was made greater than in the case shown in FIG. 6 by about 1.7 mm, and the resistance value corresponding to the effective wiring length of the second resistor element 54 was made higher than in the case of FIG. 6 by 10 MΩ.

In the step of printing the high-resistance paste material, when a resistance value lower than a predetermined resistance is obtained between the first resistor elements 51, it is necessary to decrease the resistance value between the first terminal portion 52-1 and second terminal portion 52-2. That is, it is necessary to decrease the effective wiring length of the second resistor element 54 between the first terminal portion 52-1 and second terminal portion 52-2.

Figure 8:
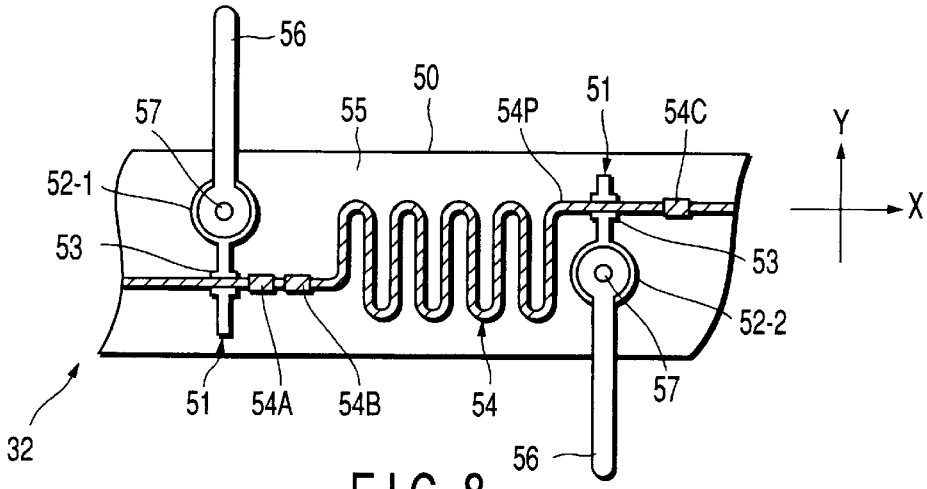
FIG. 8 is a plan view schematically showing the structure of the part of the resistor for an electron gun assembly according to the second embodiment.

In this case, as shown in FIG. 8, the pattern corresponding to the second resistor element 54 on the screen is shifted by a predetermined amount, e.g. +1.7 mm, from the reference position in the direction X of extension of the second resistor element 54. Specifically, the screen is aligned such that the pattern corresponding to the first resistance adjusting portion 54A of second resistor element 54 is positioned between the connection portion 53 associated with the first terminal portion 52-1 and the connection portion 53 associated with the second terminal portion 52-2. The high-resistance paste material is print-coated through the screen.

In the second resistor element 54, the first resistance adjusting portion 54A and second resistance adjusting portion 54B are positioned between the first terminal portion 52-1 and second terminal portion 52-2, and the third resistance adjusting portion 54C is not positioned between the first terminal portion 52-1 and second terminal portion 52-2. In this case, the effective wiring length of the second resistor element 54 corresponds to the length between the second resistance adjusting portion 54B located near the connection portion 53 of first terminal portion 52-1 and that portion of the effective wiring portion 54P, which contacts the connection portion 53 of first terminal portion 52-2.

Accordingly, the effective wiring length of the second resistor element 54 between the first terminal portion 52-1 and second terminal portion 52-2 is made less than in the case shown in FIG. 6. Thus, the resistance value corresponding to the effective wiring length of the second resistor element 54 is made lower than in the case of FIG. 6. In this embodiment, the effective wiring length of the second resistor element 54 was made less than in the case shown in FIG. 6 by about 1.7 mm, and the resistance value corresponding to the effective wiring length of the second resistor element 54 was made lower than in the case of FIG. 6 by 8 MΩ.

According to the second embodiment, as is shown in the table of FIG. 13, in the example of FIG. 7, compared to the example of FIG. 6, the resistance division ratio RD1 of voltage applied via the metal tab 56 connected to the first terminal portion 52-1 increased by 1.1%, and the resistance division ratio RD2 of voltage applied via the metal tab 56 connected to the second terminal portion 52-2 increased by 0.8%. In the example of FIG. 8, compared to the example of FIG. 6, the resistance division ratio RD1 decreased by 1.2%, and the resistance division ratio RD2 decreased by 1.1%.

As has been described above, in the second embodiment, too, the resistor can be manufactured by easily varying the effective wiring length of the second resistor element provided between the first resistor elements. Thus, the same advantages as with the first embodiment can be obtained.

Third Embodiment

Figure 9:
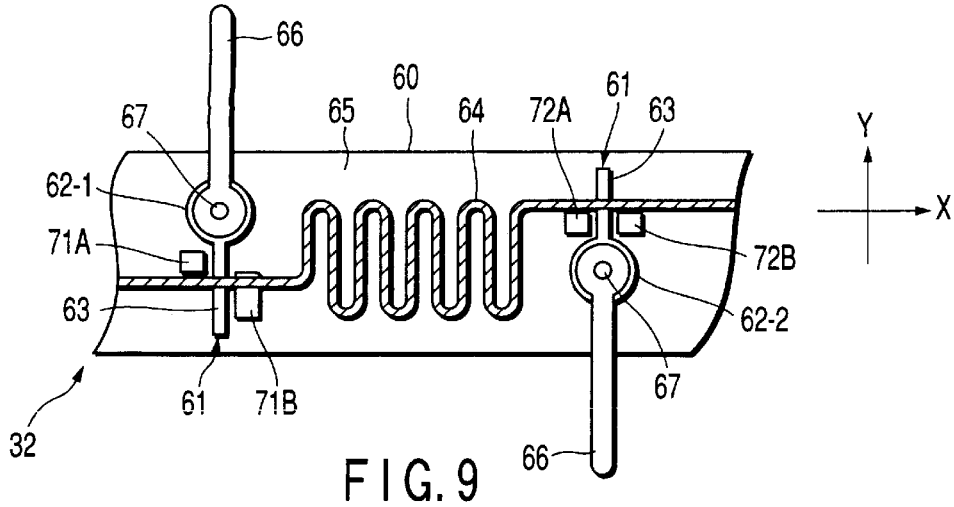
FIG. 9 is a plan view schematically showing the structure of a part of a resistor for an electron gun assembly according to a third embodiment of the invention.

As shown in FIGS. 9 and 12, the resistor 32 comprises an insulative substrate 60, a plurality of first resistor elements 61 disposed at predetermined positions on the insulative substrate 60, a second resistor element 64 having a predetermined pattern which electrically connects the first resistor elements 61, a glass insulation coating film 65 and metal tabs 66. This resistor 32 is formed of the same material and by the same method as in the first embodiment. However, in the third embodiment, the patterns of the first resistor elements 61 and second resistor element 64 are different from those in the first embodiment, and insular third resistor elements are provided as resistance adjusting portions.

The first resistor elements 61 include terminal portions 62 (−1, −2, . . . ) and connection portions 63. The connection portions 63 are provided in association with the terminal portions 62, and these are electrically connected. In the first resistor element 61, the terminal portion 62 and connection portion 63 are integrally formed. The terminal portion 62 and connection portion 63 may be formed in the same step or different steps.

The second resistor element 64 has a predetermined pattern, e.g. a corrugated pattern, and is arranged to contact the connection portion 63 of each first resistor element 61.

Third resistor elements 71A, 71B and 72A, 72B are formed of a low-resistance material, e.g. the same material as the first resistor elements 61, by the same step as the first resistor elements 61. The third resistor elements 71A, 71B and 72A, 72B are provided in insular shapes at positions separated from the first resistor elements 61.

The third resistor elements 71A, 71B are disposed near the first terminal portion 62-1. The third resistor element 71A is disposed on that side of the connection portion 63 associated with the first terminal portion 62-1, which is away from the second terminal portion 62-2. The third resistor element 71B is disposed on that side of the connection portion 63 associated with the first terminal portion 62-1, which is closer to the second terminal portion 62-2.

The third resistor elements 72A, 72B are disposed near the second terminal portion 62-2. The third resistor element 72A is disposed on that side of the connection portion 63 associated with the second terminal portion 62-2, which is closer to the first terminal portion 62-1. The third resistor element 72B is disposed on that side of the connection portion 63 associated with the second terminal portion 62-2, which is away from the first terminal portion 62-1.

The third resistor elements 71A, 71B and 72A, 72B are configured such that the effective wiring length of the second resistor element 64 provided between the first resistor elements 61 varies in accordance with the position of the second resistor element 64 relative to the first resistor elements 61. The third resistor elements 71A, 72A and 72B are formed in a square shape with a size of, e.g. 1.0 mm×1.0 mm. The third resistor element 71B is formed in a rectangular shape with a size of, e.g. 2.0 mm×1.0 mm.

The third resistor elements 71A, 71B and 72A, 72B have lower resistance than the second resistor element 64. Accordingly, the effective wiring length of the second resistor element is determined by the position of contact with the third resistor element or the connection portion of the first resistor element.

Specifically, in the step of printing the high-resistance paste material for forming the second resistor element 64, when a predetermined resistance is obtained between the first resistor elements 61, the screen is aligned at the reference position, as shown in FIG. 9. That is, the screen is aligned such that the pattern corresponding to the second resistor element 64 may contact the connection portion 63 associated with the first terminal portion 62-1 and the third resistor element 71B. The high-resistance paste material is print-coated through the screen.

The formed second resistor element 64 contacts the connection portion 63 of the first resistor element 61 associated with the second terminal portion 62-2 and does not contact the third resistor elements 71A, 72A and 72B. In this case, the effective wiring length of the second resistor element 64 corresponds to the length between the third resistor element 71B located near the connection portion 63 of first terminal portion 62-1 and the position of contact with the connection portion 63 of the second terminal portion 62-2.

On the other hand, in the step of printing the high-resistance paste material, when a resistance value higher than a predetermined resistance is obtained between the first resistor elements 61, it is necessary to increase the resistance value between the first terminal portion 62-1 and second terminal portion 62-2. That is, it is necessary to increase the effective wiring length of the second resistor element 64 between the first terminal portion 62-1 and second terminal portion 62-2.

Figure 10:
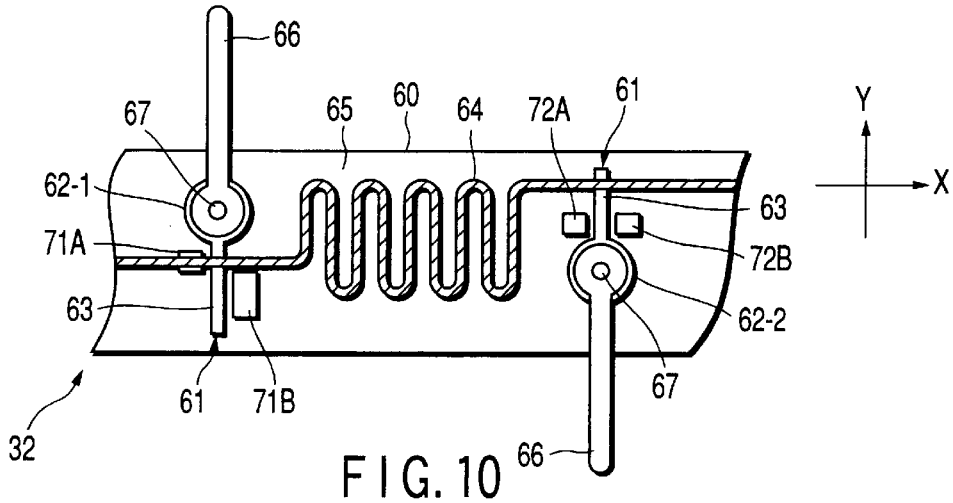
FIG. 10 is a plan view schematically showing the structure of the part of the resistor for an electron gun assembly according to the third embodiment.

In this case, as shown in FIG. 10, the pattern corresponding to the second resistor element 64 on the screen is shifted by a predetermined amount, e.g. +1.0 mm, from the reference position in the direction Y perpendicular to the direction X of extension of the second resistor element 64. Specifically, the screen is aligned such that the pattern corresponding to the second resistor element 64 may contact the connection portion 63 associated with the first terminal portion 62-1 and the third resistor element 71A. The high-resistance paste material is print-coated through the screen.

The formed second resistor element 64 contacts the connection portion 63 of the first resistor element 61 associated with the second terminal portion 62-2 and does not contact the third resistor elements 71B, 72A and 72B. In this case, the effective wiring length of the second resistor element 64 corresponds to the length between the position of contact with the connection portion 63 of first terminal portion 62-1 and the position of contact with the connection portion 63 of the second terminal portion 62-2.

Accordingly, the effective wiring length of the second resistor element 64 between the first terminal portion 62-1 and second terminal portion 62-2 is made greater than in the case shown in FIG. 9. Thus, the resistance value corresponding to the effective wiring length of the second resistor element 64 is made higher than in the case of FIG. 9. In this embodiment, the effective wiring length of the second resistor element 64 was made greater than in the case shown in FIG. 9 by about 1.0 mm, and the resistance value corresponding to the effective wiring length of the second resistor element 64 was made higher than in the case of FIG. 9 by 23 MΩ.

In the step of printing the high-resistance paste material, when a resistance value lower than a predetermined resistance is obtained between the first resistor elements 61, it is necessary to decrease the resistance value between the first terminal portion 62-1 and second terminal portion 62-2. That is, it is necessary to decrease the effective wiring length of the second resistor element 64 between the first terminal portion 62-1 and second terminal portion 62-2.

Figure 11:
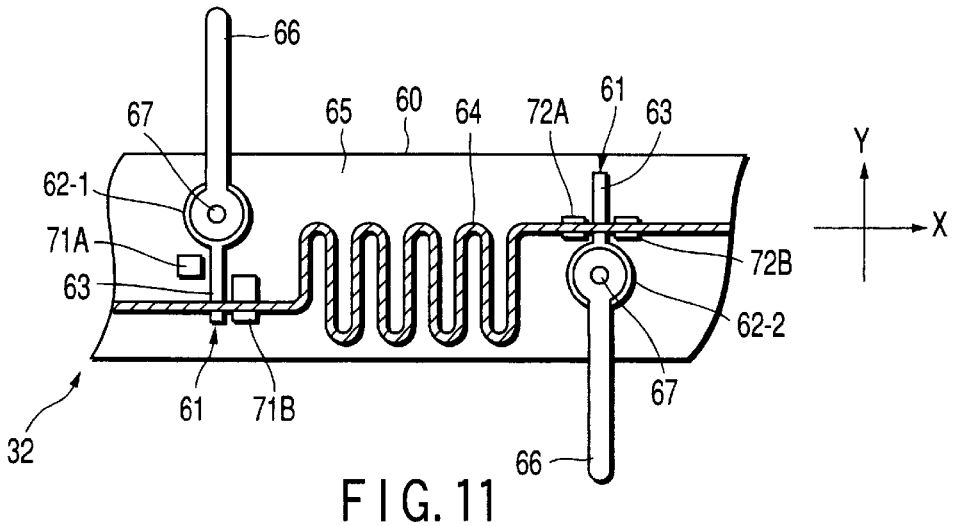
FIG. 11 is a plan view schematically showing the structure of the part of the resistor for an electron gun assembly according to the third embodiment.

In this case, as shown in FIG. 11, the pattern corresponding to the second resistor element 64 on the screen is shifted by a predetermined amount, e.g. −1.0 mm, from the reference position in the direction Y. Specifically, the screen is aligned such that the pattern corresponding to the second resistor element 64 may contact the connection portion 63 associated with the first terminal portion 62-1 and the third resistor elements 71B, 72A and 72B. The high-resistance paste material is print-coated through the screen.

The formed second resistor element 64 contacts the connection portion 63 associated with the second terminal portion 62-2 and does not contact the third resistor element 71A. In this case, the effective wiring length of the second resistor element 64 corresponds to the length between the third resistor element 71B located near the connection portion 63 of first terminal portion 62-1 and the third resistor element 72A located near the connection portion 63 of second terminal portion 62-2.

Accordingly, the effective wiring length of the second resistor element 64 between the first terminal portion 62-1 and second terminal portion 62-2 is made less than in the case shown in FIG. 9. Thus, the resistance value corresponding to the effective wiring length of the second resistor element 64 is made lower than in the case of FIG. 9. In this embodiment, the effective wiring length of the second resistor element 64 was made less than in the case shown in FIG. 9 by about 1.0 mm, and the resistance value corresponding to the effective wiring length of the second resistor element 64 was made lower than in the case of FIG. 9 by 19 MΩ.

According to the third embodiment, as is shown in the table of FIG. 13, in the example of FIG. 10, compared to the example of FIG. 9, the resistance division ratio RD1 of voltage applied via the metal tab 66 connected to the first terminal portion 62-1 increased by 1.0%, and the resistance division ratio RD2 of voltage applied via the metal tab 66 connected to the second terminal portion 62-2 increased by 0.9%. In the example of FIG. 11, compared to the example of FIG. 9, the resistance division ratio RD1 decreased by 1.0%, and the resistance division ratio RD2 decreased by 1.0%.

In the above-described third embodiment, the third resistor elements are formed of the same resistance material as the first resistor elements, and at the same time as the first resistor elements. However, these may be formed in different steps. The third resistor elements may be formed of a high resistance material.

As has been described above, in the third embodiment, too, the resistor can be manufactured by easily varying the effective wiring length of the second resistor element provided between the first resistor elements. Thus, the same advantages as with the first embodiment can be obtained.

In the above embodiments, the resistor is configured such that the effective wiring length of the second resistor element can be decreased and increased in order to meet the cases where a desired resistance division ratio is made greater or less than a predetermined value. However, the amount of variation of the resistance division ratio relative to the predetermined value is very small, and there are cases where the second resistor element needs to be configured to have a more finely adjustable effective wiring length. Needless to say, the present invention is applicable to such cases. More specifically, the resistance adjusting portions provided on the first resistor elements, second resistor element and third resistor elements are not limited to the structures of the above-described embodiments and can be variously modified. The resistance adjusting portions, which have been described in connection with the above embodiments, have only structures matching with the case of obtaining a reference resistance value, the case of making the resistance value greater than the reference resistance value, and the case of making the resistance value less than the reference resistance value. When more accurate adjustment needs to be carried out, more adjusting portions may be provided.

The order of forming the first resistor elements, second resistor element and third resistor elements may be different from that in each of the above embodiments. For example, the first resistor elements may be formed after the formation of the second resistor element. Alternatively, the third resistor elements may be formed after the formation of the first resistor elements and second resistor element.

The two terminal portions in the above embodiments may be associated with the terminal A and terminal 32-2 of the resistor 32, or with the terminal 32-1 and terminal 32-2, or with the terminal B and terminal 32-1. In the above embodiments, the resistance value between the two terminal portions is adjusted to vary the resistance division ratio. Alternatively, the resistance values may be adjusted at the same time among a plurality of terminal portions.

As has been described above, according to the embodiments, the position of arrangement of the second resistor element is changed relative to the first resistor elements, whereby the effective wiring length of the second resistor element disposed between the first resistor elements is varied. Accordingly, in the process of manufacturing the resistor, the resistance value corresponding to the effective wiring length of the second resistor element can easily be varied. By adjusting the resistance value between the first resistor elements, the resistance division ratio can easily be altered and a predetermined necessary resistance division ratio can be obtained.

When a supply voltage needs to be varied in accordance with a change of specifications of the electron gun assembly, there is no need to design a new resistor. A resistor confirming to changed specifications of the electron gun assembly can be put to practical use in a shorter time. In addition, when a resistance value needs to be adjusted in the process of manufacturing the resistor using screen printing, there is no need to repeat trial printing, and a non-usable screen does not occur. A desired resistance division ratio can be obtained in accordance with the characteristics of the screen.

Therefore, it is possible to manufacture a resistor which can easily be provided with a predetermined resistance division ratio, without causing a decrease in manufacturing yield.

It is possible to prevent the manufacturing yield from lowering, or non-usable screens from occurring, due to a shift of a resistance division ratio caused by a variance among screens used in the manufacturing process.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A resistor for an electron gun assembly, for applying a resistor-divided voltage to an electrode provided in the electron gun assembly, the resistor comprising:

an insulative substrate;

a plurality of first resistor elements disposed at predetermined positions on the insulative substrate; and a second resistor element having a predetermined pattern which electrically connects the first resistor elements, wherein the resistor has a structure in which an effective length of the second resistor element between the first resistor elements varies in accordance with a position of the second resistor element relative to the first resistor elements.

2. A resistor for an electron gun assembly according to claim 1, wherein at least one of the first resistor element and the second resistor element has a resistance adjusting portion for adjusting a resistance value corresponding to the effective length at a predetermined value.

3. A resistor for an electron gun assembly according to claim 2, wherein the resistance adjusting portion of the first resistor element has a stepwise shape.

4. A resistor for an electron gun assembly according to claim 2, wherein the resistance adjusting portion of the second resistor element has a greater line width than the other portion thereof.

5. A resistor for an electron gun assembly according to claim 1, further comprising a third resistor element disposed in an insular shape to adjust a resistance value corresponding to the effective length at a predetermined value.

6. A resistor for an electron gun assembly according to claim 1, wherein the first resistor elements have a lower resistance than the second resistor element.

7. A method of manufacturing a resistor for an electron gun assembly, for applying a resistor-divided voltage to an electrode provided in the electron gun assembly, the method comprising:

a step of forming a plurality of first resistor elements disposed at predetermined positions on an insulative substrate; and a step of forming a second resistor element having a predetermined pattern which electrically connects the first resistor elements, wherein an effective length of the second resistor element between the first resistor elements varies in accordance with a position of the second resistor element relative to the first resistor elements.

8. A method of manufacturing a resistor for an electron gun assembly according to claim 7, wherein at least one of the first resistor element and the second resistor element has a resistance adjusting portion for adjusting a resistance value corresponding to the effective length at a predetermined value.

9. A method of manufacturing a resistor for an electron gun assembly according to claim 8, wherein the resistance adjusting portion of the first resistor element has a stepwise shape.

10. A method of manufacturing a resistor for an electron gun assembly according to claim 8, wherein the resistance adjusting portion of the second resistor element has a greater line width than the other portion thereof.

11. A method of manufacturing a resistor for an electron gun assembly according to claim 8, further comprising a third resistor element disposed in an insular shape to adjust a resistance value corresponding to the effective length at a predetermined value.

12. A method of manufacturing a resistor for an electron gun assembly according to claim 7, wherein the first resistor elements have a lower resistance than the second resistor element.

13. A method of manufacturing a resistor for an electron gun assembly according to claim 7, wherein a connection position of the second resistor element relative to the first resistor elements is varied to increase the effective length when a resistance value corresponding to the effective length is to be made higher than a predetermined value, and the connection position of the second resistor element relative to the first resistor elements is varied to decrease the effective length when the resistance value corresponding to the effective length is to be made lower than a predetermined value.

14. A method of manufacturing a resistor for an electron gun assembly according to claim 13, wherein said connection position is varied by forming the second resistor element with a shift in a direction of extension of the second resistor element or a direction perpendicular to the direction of extension of the second resistor element.

15. An electron gun assembly comprising a plurality of electrodes constituting an electron lens section for focusing or diverging electron beams, and a resistor for applying a resistor-divided voltage to at least one of the electrodes, wherein the resistor comprises:

an insulative substrate;

a plurality of first resistor elements disposed at predetermined positions on the insulative substrate; and a second resistor element having a predetermined pattern which electrically connects the first resistor elements, and wherein the resistor has a structure in which an effective length of the second resistor element between the first resistor elements varies in accordance with a position of the second resistor element relative to the first resistor elements.

16. A cathode-ray tube apparatus comprising:

an electron gun assembly comprising a plurality of electrodes constituting an electron lens section for focusing or diverging electron beams, and a resistor for applying a resistor-divided voltage to at least one of the electrodes; and a deflection yoke for producing deflection magnetic fields for deflecting the electron beams emitted from the electron gun assembly, wherein the resistor comprises:

an insulative substrate;

a plurality of first resistor elements disposed at predetermined positions on the insulative substrate; and a second resistor element having a predetermined pattern which electrically connects the first resistor elements, and wherein the resistor has a structure in which an effective length of the second resistor element between the first resistor elements varies in accordance with a position of the second resistor element relative to the first resistor elements.

* * * * *